US008624480B2

(12) United States Patent
Maeda

(10) Patent No.: US 8,624,480 B2
(45) Date of Patent: Jan. 7, 2014

(54) VACUUM FLUORESCENT DISPLAY WITH DRIVER IC

(75) Inventor: Tadami Maeda, Mie (JP)

(73) Assignees: Noritake Itron Corporation, Mie (JP); Noritake Co., Limited, Aichi (JP)

( * ) Notice: Subject to any disclaimer, the term of this patent is extended or adjusted under 35 U.S.C. 154(b) by 410 days.

(21) Appl. No.: 13/068,544

(22) Filed: May 13, 2011

(65) Prior Publication Data

US 2011/0279425 A1 Nov. 17, 2011

(30) Foreign Application Priority Data

May 17, 2010 (JP) ..... P2010-113584

(51) Int. Cl.
*H01J 1/94* (2006.01)
*H01J 17/04* (2012.01)

(52) U.S. Cl.
USPC ..... 313/495; 313/272; 313/496

(58) Field of Classification Search
USPC ..... 313/495–497, 272–279
See application file for complete search history.

(56) References Cited

U.S. PATENT DOCUMENTS

| | | | | |
|---|---|---|---|---|
| 6,717,350 | B2 * | 4/2004 | Yonezawa et al. | 313/495 |
| 2004/0150323 | A1 * | 8/2004 | Yonezawa et al. | 313/495 |
| 2004/0183429 | A1 * | 9/2004 | Yonezawa et al. | 313/495 |

FOREIGN PATENT DOCUMENTS

| | | | | |
|---|---|---|---|---|
| JP | 52-113767 | U | | 2/1976 |
| JP | HO1-46948 | U | | 3/1989 |
| JP | 04-074836 | U | | 6/1992 |
| JP | HO5-36741 | U | | 5/1993 |
| JP | 05-190123 | A | | 7/1993 |
| JP | 05-325847 | A | | 12/1993 |
| JP | HO6-51335 | U | | 2/1994 |
| JP | 06076769 | A | * | 3/1994 |
| JP | 06119891 | A | * | 4/1994 |
| JP | 06-203774 | A | | 7/1994 |
| JP | 08-007810 | A | | 1/1996 |
| JP | 09-147766 | A | | 6/1997 |
| JP | 2002-157966 | A | | 5/2002 |
| JP | 2004-134149 | A | | 4/2004 |

* cited by examiner

*Primary Examiner* — Mariceli Santiago
(74) *Attorney, Agent, or Firm* — Hedman & Costigan, P.C.; James V. Costigan; Kathleen A. Costigan

(57) ABSTRACT

The distance between filamentary cathodes and a phosphor on an anode substrate can be reduced by shortening the distance between the filamentary cathodes and a grid. To obtain high luminance without loss of display quality, the present invention provides a vacuum fluorescent display (1) with a driver IC, comprising a display unit (3) provided with a phosphor layer on an anode substrate (2), a plurality of filamentary cathodes (5), a grid (4), a driver IC (6), and a filament support (7) for shielding the IC and supporting an end part of the filamentary cathodes. The end part of the filamentary cathodes is fixed to one short side of the vacuum fluorescent display at a long side of the filament support. Depressions are provided to a surface of the filament support, or slits are provided to the filament support.

8 Claims, 7 Drawing Sheets

VACUUM FLUORESCENT DISPLAY WITH DRIVER IC

TECHNICAL FIELD

The present invention relates to a vacuum fluorescent display with a driver IC, and particularly relates to a filament support structure of the vacuum fluorescent display.

TECHNICAL BACKGROUND

Vacuum fluorescent displays with a driver IC (also referred to below as CIG-VFDs) can have a driver IC mounted inside the vacuum fluorescent display, and are therefore capable of a reduced package size, as well as high density and display capacity.

A filament support provided to a metal cover of an IC shield is known in the prior art as an example of a filament support structure of a CIG-VFD (Unexamined Utility Model Application Publication No. 1-46948). Examples (Patent Reference 2, Patent Reference 3) are also known in which the filament support is provided separately from the metal IC shield to an end part of a metal frame whereon a metal IC shield for shielding the driver IC is mounted (Unexamined Utility Model Application Publication No. 5-36741, Japanese Laid-open Patent Application Publication No. 6-51335).

There has been demand in recent years for a higher-definition dot pitch in full-dot-type graphic CIG-VFDs. The graphic CIG-VFDs generally employ a dynamic scan drive as a drive method. However, when a high definition is reached wherein the pixel pitch of the display unit is at a level of 0.325 mm, the grid cut-off voltage effect increases, and light and dark parts become markedly more noticeable in comparison with a roughly pixilated display at a pixel pitch level of 0.65 mm. It is known that the distance between a grid and an anode substrate can be reduced in order to solve this problem, but a problem has been encountered in the prior art in that reducing this distance leads to a decrease in display luminance and a loss of display quality.

Accordingly, in order to prevent a decrease in display luminance, an arrangement has been considered wherein the distance between a filamentary cathode and a phosphor on the anode substrate is reduced by setting the distance between the filamentary cathode and the grid to be shorter than in a conventional product.

SUMMARY OF THE INVENTION

Problems to be Solved by the Invention

However, there is a problem in that the distance between the filamentary cathode and the grid in a CIG-VFD cannot be reduced.

The filamentary cathode and the filament support are usually subjected to a cut-off bias voltage in the driving of a CIG-VFD.

Also, the bonding wire on the driver IC serves as an anode, grid, logic+, or logic GND and must be prevented from coming into contact with the filament support.

Accordingly, the filament support must be maintained at a constant distance from the surface of the anode substrate so as to prevent the bonding wire of the driver IC mounted underneath the filament support from coming into contact with the filament support.

The problem is that a certain constant luminance or greater cannot be obtained because the minimum distance between the filamentary cathode and a phosphor is determined by the factors described above, even when an attempt is made to reduce the distance between the filamentary cathode and the phosphor and to achieve increased luminance.

An object of the present invention, which was devised in order to address such problems, is to provide a high-definition graphic CIG-VFD in which the distance between the filamentary cathode and the phosphor on the anode substrate can be reduced and high luminance obtained without a loss of display quality by shortening the distance between the filamentary cathode and the grid.

Means to Solve the Problems

The present invention provides a CIG-VFD comprising a display unit provided with a phosphor layer on an anode substrate, a plurality of filamentary cathodes installed above the display unit, a grid disposed between the filamentary cathodes and the display unit, an IC (also referred to below as a "driver IC") mounted on the anode substrate within an end cooling area of the filamentary cathodes and adapted to drive the display unit, and a filament support for shielding the driver IC from electrons generated by the cathodes and supporting an end part of the filamentary cathodes; wherein the phosphor layer is excited and caused to emit light by irradiating the phosphor layer with electrons generated from the filamentary cathodes; characterized in that the end part of the filamentary cathodes is fixed to one short side of the vacuum fluorescent display at a long side of the filament support; a depression is provided to a surface of the filament support disposed below the end cooling area of the filamentary cathodes, or a slit is provided to the filament support; the filamentary cathodes and the surface of the filament support are prevented from making contact; and the distance between the filamentary cathodes and the phosphor layer is reduced.

In particular, the present invention is characterized in that the depression or slit formed on a surface of the filament support is provided in a plural number in parallel to each of the plurality of filamentary cathodes.

The present invention is also characterized in that one end of the filamentary cathodes fixed to the filament support is fixed to a surface of the filament support.

The present invention is also characterized in that an end part of the filament support to which one end of the filamentary cathodes is fixed forms an opening relative to the anode substrate of the vacuum fluorescent display.

Advantageous Effects of the Invention

Since depressions are provided to the surface of the filament support to which one end of the filamentary cathodes is fixed, or slits are provided to the filament support, the distance between the filamentary cathodes and the phosphor can be reduced. Therefore, the vacuum fluorescent display with a driver IC according to the present invention can produce high luminance without loss of display quality, even in high-definition graphic CIG-VFDs.

Also, because one end of the filamentary cathodes is fixed to the surface of the filament support, the press-shape of the filament support itself can be more simplified compared with the conventional product. The press-shape is accordingly stable, and the die used for press becomes less expensive than the conventional product.

DESCRIPTION OF THE EMBODIMENTS

Figure 1:
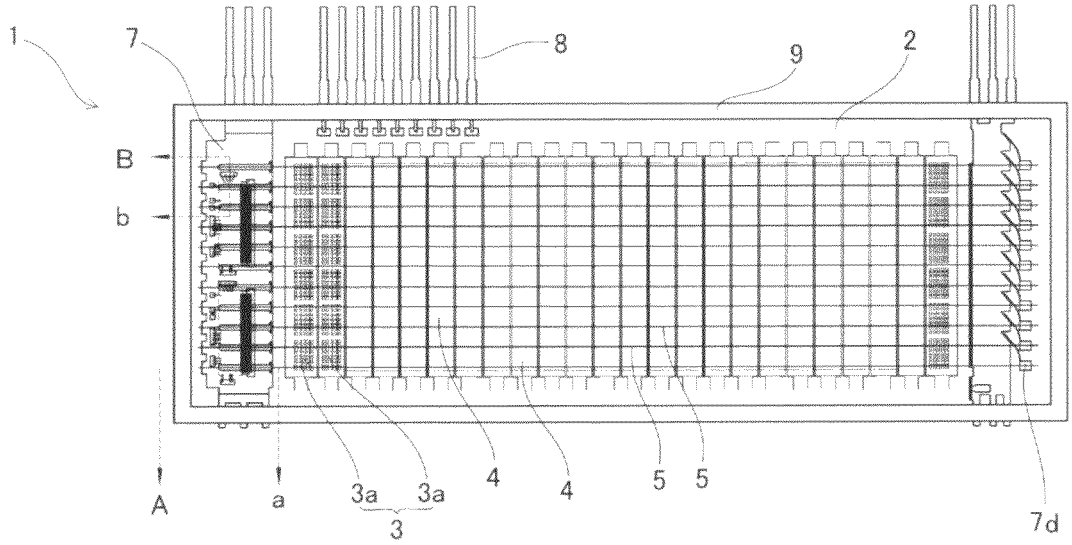
FIG. 1 is a plan view showing the structure of the CIG-VFD.

The CIG-VFD of the present invention will now be described with reference to FIGS. 1 to 3. FIG. 1 is a plan view showing the structure of the CIG-VFD, FIG. 2 is a cross-sectional view of A-a in FIG. 1, and FIG. 3 is a cross-sectional view of B-b in FIG. 1.

Figure 2:
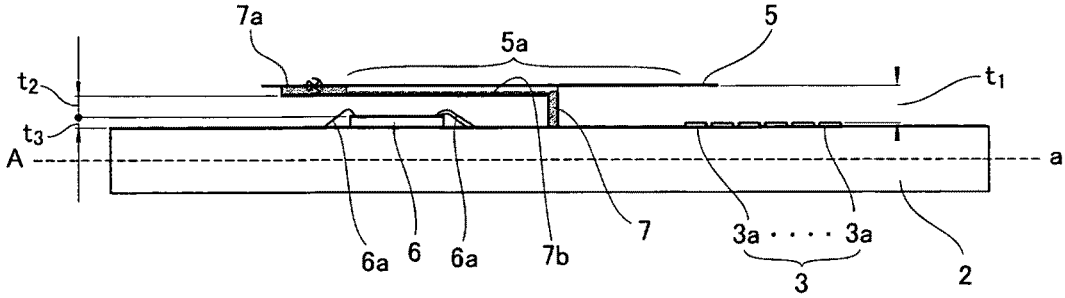
FIG. 2 is a cross-sectional view of A-a in FIG. 1.
Figure 3:
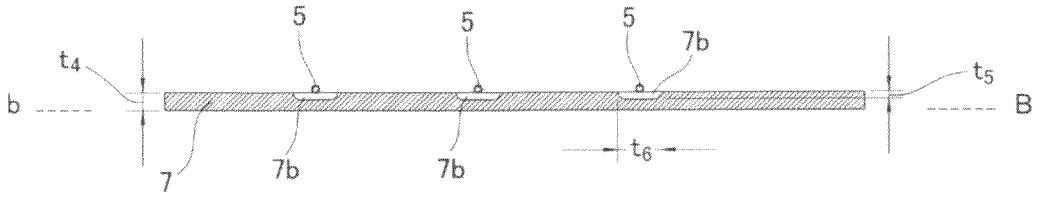
FIG. 3 is a cross-sectional view of B-b in FIG. 1.

A CIG-VFD 1 comprises a display unit 3 comprising at least an aluminum or other wiring (not shown) on an anode substrate 2, and an anode that is formed in a matrix pattern in a predetermined area of the wires and that has a phosphor layer 3*a* adhered thereto, and also comprises a plurality of grids 4 provided substantially parallel to each other above the display unit 3 so as to cover the display unit 3, and a plurality of filamentary cathodes 5 installed above the grids 4, as shown in FIGS. 1 to 3. The CIG-VFD 1 also comprises a driver IC 6 mounted on the anode substrate 2 within an end cooling area 5*a* of the filamentary cathodes 5 and adapted to drive the display unit 3, and a filament support 7 that protectively shields the driver IC 6 from an electron beam generated by the cathode 5 and acts as a support for one end of the filamentary cathodes 5. The other end of the filamentary cathodes 5 is fixed to an anchor 7*d* provided to the opposite side of the anode substrate 2 to secure the filamentary cathode 5 in a stretched state. The driver IC 6 is electrically connected to the anode substrate 2 by a bonding wire 6*a*. Numeral 8 is a lead pin.

The CIG-VFD 1 is constructed of an external peripheral device in which a front glass (not shown) at least partially having permeability and a spacer glass 9 are bonded together using fritted glass to form a vacuum vessel.

The above-described CIG-VFD 1 is a display in which the phosphor layer 3*a* is excited and caused to emit light by irradiation of the phosphor layer 3*a* via the grids 4 with electrons generated from the filamentary cathodes 5.

The filamentary cathodes 5 are fixed to an end part 7*a* of the filament support 7. In the end part 7*a*, the end cooling area 5*a* of the filamentary cathodes 5 is fixed to the end part 7*a* by welding or the like so as to be positioned above the filament support 7.

Depressions 7*b* are provided to the surface of the filament support 7 positioned underneath the end cooling area 5*a* of the filamentary cathodes 5, as shown in FIGS. 2 and 3.

Providing the surface with the depressions 7*b* allows the filamentary cathodes 5 to be fixed to the surface of the filament support 7. Providing the depressions 7*b* and fixing the cathodes to the surface of the filament support 7 allows the filament height $t_1$, which is the distance between the filamentary cathodes 5 and the phosphor layer 3*a*, to be markedly reduced by about 20% in comparison with a conventional example in which the depressions 7*b* are not provided. It should be noted that slits 7*c* may be provided in place of the depressions 7*b*.

The distance $t_2$ between the upper surface of the driver IC 6 and the filament support 7 is determined by the thickness $t_3$ of the driver IC 6 and the shape of the bonding wire 6*a*, and therefore is a distance that cannot be changed in terms of the design of the filament support 7.

The thickness $t_4$ of the filament support 7 is determined by the size of the vacuum fluorescent display 1.

Figure 4:
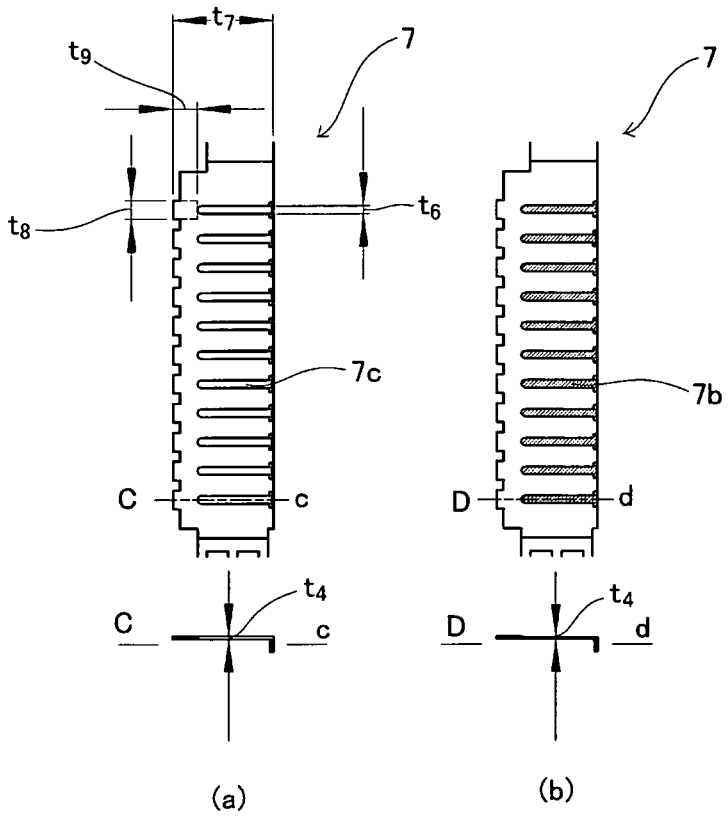
FIG. 4 is a plan view of the filament support.

FIG. 4 shows a plan view of the filament support 7 provided with the depressions 7*b* or the slits 7*c*. FIG. 4(*a*) is an example in which the slits 7*c* are provided, and FIG. 4(*b*) is an example in which the depressions 7*b* are provided.

Taking as an example a case in which the size of the vacuum fluorescent display 1 is such that the length of the short side in the planar view of FIG. 1 is 35 mm and the length of the long side is 96 mm, the short-side length $t_7$ of the filament support 7 usually depends on the horizontal and vertical size of the driver IC 6 in the planar view, but is usually about 7.5 mm when the length of the filamentary cathodes 5 is 86 mm and the thickness $t_4$ of the filament support 7 is 0.25 mm. The corresponding margin to weld ($t_8 \times t_9$) of the filament support 7 is usually 1.4 mm×1.8 mm.

The depressions 7*b* or slits 7*c* formed on the surface of the filament support 7 are provided in parallel to the lower surfaces of the plurality of filamentary cathodes 5 in a corresponding manner. Forming the depressions or slits in the lower surfaces of the filamentary cathodes 5 allows contact between the filamentary cathodes 5 and the filament support 7 to be avoided.

The depressions 7*b* or slits 7*c* can be readily formed by half-etching, press working, or the like.

The width $t_6$ of the depressions 7*b* and the slits 7*c* must be such that the filamentary cathodes 5 are prevented from making contact with the filament support 7 by vibration from the exterior when the vacuum fluorescent display is operated. The width may, for example, be in the range of 0.2 to 0.6 mm in the case of a vacuum fluorescent display in which the length of the short side is 35 mm and the length of the long side is 96 mm.

The width $t_6$ of the depressions 7*b* may be increased in a case in which the mechanical strength can be maintained. Alternatively, the width may be such that the fan-shaped depressions open toward the center of the vacuum fluorescent display relative to the filamentary cathodes 5.

Furthermore, the step in the conventional example can be reduced and the depressions 7*b* or slits 7*c* provided.

The filamentary cathodes 5 are prevented from making contact with the filament support 7 under the action of vibration from the exterior by setting the width $t_6$ of the depressions 7*b* and slits 7*c* to within the range described above, and the depth $t_5$ of the depressions 7*b* to within the range described below. The filament support 7 also has a tabular shape, which improves ease of processing when the filamentary cathodes 5 are welded to the filament support 7.

Figure 5:
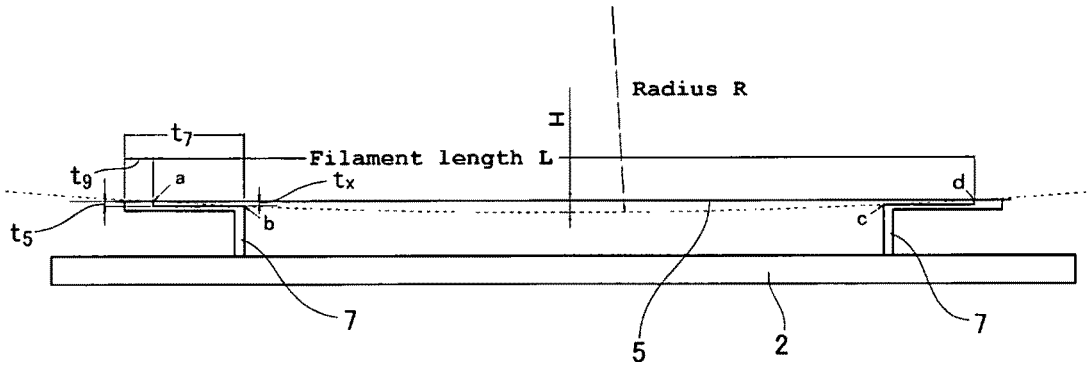
FIG. 5 is a relationship diagram of a condition in which the filamentary cathodes are in contact with the filament support.

A state in which the filamentary cathodes 5 are brought into contact with the filament support 7 by vibration is illustrated by FIG. 5, taking as an example the case of a vacuum fluorescent display in which the length of the short side is 35 mm and the length of the long side is 96 mm. FIG. 5 is a relationship diagram of a condition in which the filamentary cathodes 5 and the filament support 7 are in contact with each other.

In FIG. 5, the other end of the filamentary cathodes 5 is fixed to the filament anchor 7*d*, and tensile force is applied to the filamentary cathodes 5; however, for illustrative convenience both ends of the filamentary cathodes 5 have the shape of the filament support 7.

Following is a calculation of the distance $t_x$ in an arrangement in which the filamentary cathodes 5 are fixed at point "a" of the filament support 7, and the filamentary cathodes 5 are in contact with point "b." Determining the radius R of the arc described by the vibrating filamentary cathodes 5 gives R=1841 mm. Based on this value, the maximum oscillation width H of the filamentary cathodes 5 is 0.5 mm, and $t_x$ is 0.125 mm; the depth $t_5$ of the depressions 7*b* can be assumed to be 0.13 mm if solely the vibration of the filamentary cathodes 5 is taken into account. Similarly, the width $t_6$ of the depressions 7*b* can be assumed to be 0.13 mm.

Figure 6:
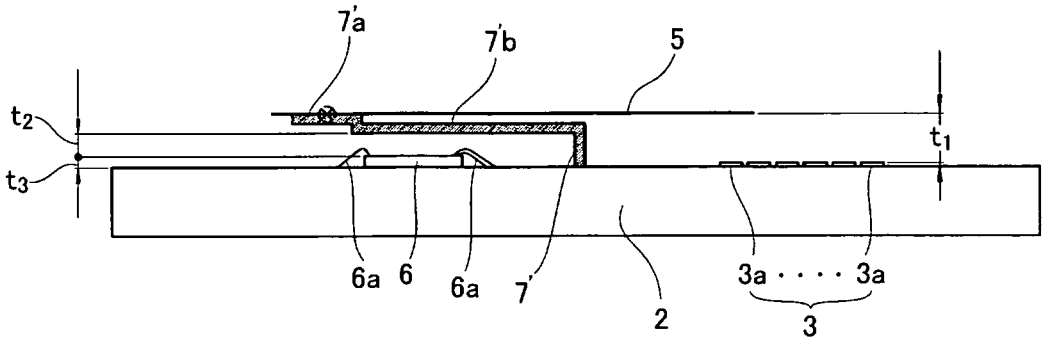
FIG. 6 is a cross-sectional view of an end part of a conventional CIG-VFD.

As a comparative example, results are described with reference to FIG. 6 of a case in which a conventional CIG-VFD having no depressions 7*b* or slits 7*c* provided to the filament support 7 is used to reduce the height of the filamentary cathodes 5. FIG. 6 is a cross-sectional view of an end part of a conventional CIG-VFD.

In FIG. 6, rather than depressions 7*b* or slits 7*c* being provided to a filament support 7', an end part of the filament support 7' is formed having a step 7'*b*. The filamentary cathodes 5 are fixed by welding to the surface of the end part 7'*a* at the step portion.

Table 1 shows a comparison with the configuration of the CIG-VFD according to the present invention as shown in FIG. 2.

TABLE 1

| | Present Invention | Conventional Example |
|---|---|---|
| Height of filamentary cathodes: $t_1$ | 1.05 mm | 1.3 mm |
| Thickness to upper surface of driver IC: $t_3$ | 0.3 mm | 0.3 mm |
| Thickness of filament support | 0.25 mm | 0.25 mm |
| Distance between upper surface of driver IC and lower surface of filamentary cathodes: $t_2$ | 0.6 mm | 0.6 mm |

As shown in Table 1, structuring the filament support in accordance with the present invention brings the height $t_1$ of the filamentary cathodes 5 to 1.05 mm in the case of the present invention, and 1.3 mm in the case of the conventional structure. The height in the case of the present invention is markedly lowered by about 20% in comparison with the conventional structure.

Figure 7:
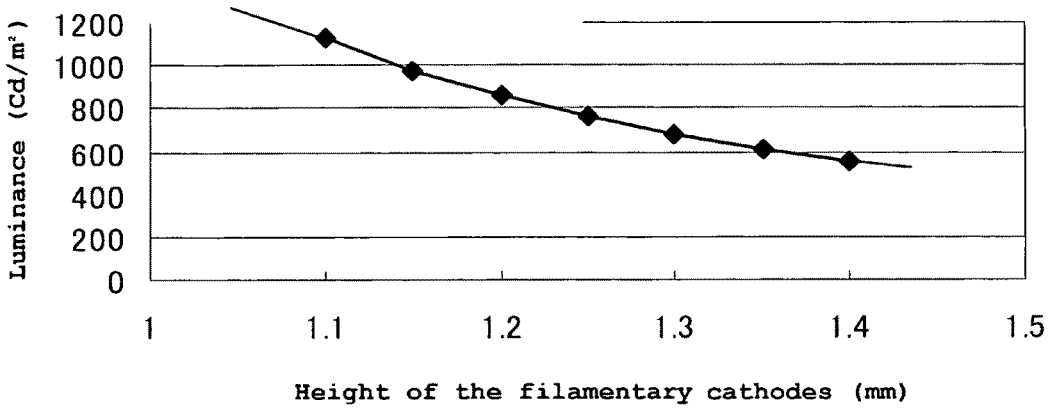
FIG. 7 is a view showing the relationship between the height of the filamentary cathodes and the luminance.

FIG. 7 shows the relationship between luminance and the height $t_1$ of the filamentary cathodes when the CIG-VFD is driven by dynamic drive under the following conditions.

Grid height: 0.5 mm
Anode voltage: 30 V
Grid voltage: 30 V
Cut-off voltage: 1 V
Duty: 1/20

The luminance is 679 Cd/m$^2$ in a case in which the height $t_1$ of the filamentary cathodes having the conventional structure is 1.3 mm, but the luminance is 1200 Cd/m$^2$ or greater in the case of the present invention where the height $t_1$ is 1.05 mm, as shown in FIG. 7. The height $t_1$ can be markedly reduced by about 20% in the present invention. Thus the luminance of the CIG-VFD can be markedly improved.

INDUSTRIAL APPLICABILITY

The CIG-VFD of the present invention can obtain higher luminance without loss of display quality, even in high-definition graphic CIG-VFDs, and therefore can be applied to all CIG-VFDs in the future.

EXPLANATION OF NUMERALS AND CHARACTERS

1 CIG-VFD
2 Anode substrate
3 Display unit
4 Grid
5 Filamentary cathode
6 Driver IC
7 Filament support
8 Lead pin
9 Spacer glass

The invention claimed is:

1. A vacuum fluorescent display with a driver IC, comprising:

a display unit provided with a phosphor layer on an anode substrate;

a plurality of filamentary cathodes installed above the display unit;

a grid disposed between the filamentary cathodes and the display unit;

an IC mounted on the anode substrate within an end cooling area of the filamentary cathodes and adapted to drive the display unit; and a filament support for shielding the IC and supporting an end part of the filamentary cathodes; wherein the phosphor layer is excited and caused to emit light by irradiating the phosphor layer with electrons generated from the filamentary cathodes;

the vacuum fluorescent display with a driver IC characterized in that the end part of the filamentary cathodes is fixed to one short side of the vacuum fluorescent display at a long side of the filament support, a depression is provided to a surface of the filament support disposed below the end cooling area of the filamentary cathodes; the filamentary cathodes and the surface of the filament support are prevented from making contact; and the distance between the filamentary cathodes and the phosphor layer is reduced.

2. The vacuum fluorescent display with a driver IC according to claim 1, wherein the depression is provided in a plural number in parallel to each of the plurality of filamentary cathodes.

3. The vacuum fluorescent display with a driver IC according to claim 1, wherein one end of filamentary cathodes fixed to the filament support is fixed to a surface of the filament support.

4. The vacuum fluorescent display with a driver IC according to claim 1, wherein an end part of the filament support to which one end of the filamentary cathodes is fixed forms an opening relative to the anode substrate.

5. A vacuum fluorescent display with a driver IC, comprising:

a display unit provided with a phosphor layer on an anode substrate;

a plurality of filamentary cathodes installed above the display unit;

a grid disposed between the filamentary cathodes and the display unit;

an IC mounted on the anode substrate within an end cooling area of the filamentary cathodes and adapted to drive the display unit; and a filament support for shielding the IC and supporting an end part of the filamentary cathodes; wherein the phosphor layer is excited and caused to emit light by irradiating the phosphor layer with electrons generated from the filamentary cathodes;

the vacuum fluorescent display with a driver IC characterized in that the end part of the filamentary cathodes is fixed to one short side of the vacuum fluorescent display at a long side of the filament support, a slit is provided to the filament support disposed below the end cooling area of the filamentary cathodes; the filamentary cathodes and a surface of the filament support are prevented from making contact; and the distance between the filamentary cathodes and the phosphor layer is reduced.

6. The vacuum fluorescent display with a driver IC according to claim 5, wherein the slit is provided in a plural number in parallel to each of the plurality of filamentary cathodes.

7. The vacuum fluorescent display with a driver IC according to claim 5, wherein one end of filamentary cathodes fixed to the filament support is fixed to a surface of the filament support.

8. The vacuum fluorescent display with a driver IC according to claim 5, wherein an end part of the filament support to which one end of the filamentary cathodes is fixed forms an opening relative to the anode substrate.

* * * * *